US005427501A

United States Patent [19]

Chu

[11] Patent Number: 5,427,501

[45] Date of Patent: Jun. 27, 1995

[54] FUEL PUMP IMPELLER WITH PUMP DOWN EXTENSION

[75] Inventor: Yu-Sen J. Chu, Westlake, Ohio

[73] Assignee: Parker-Hannifin Corporation, Cleveland, Ohio

[21] Appl. No.: 237,468

[22] Filed: May 3, 1994

[51] Int. Cl.[6] ..... F04D 13/12

[52] U.S. Cl. ..... 415/143; 415/71; 417/250

[58] Field of Search ..... 415/71, 72, 143, 199.1; 417/250

[56] References Cited

U.S. PATENT DOCUMENTS

| | | | |
|---|---|---|---|
| 140,808 | 7/1873 | Bennett . | |
| 2,846,952 | 12/1965 | Ridland . | |
| 3,038,410 | 3/1960 | Bell . | |
| 3,504,986 | 4/1970 | Jackson | 415/143 |
| 3,652,186 | 5/1970 | Carter . | |
| 3,806,278 | 4/1974 | Grennan | 415/143 |
| 4,142,839 | 3/1979 | Davis et al. . | |
| 4,275,988 | 6/1981 | Kalashnikov et al. . | |
| 4,426,190 | 1/1984 | Shapiro et al. | 415/143 |
| 4,654,418 | 2/1987 | Siegel . | |
| 4,877,368 | 10/1989 | Timperi et al. . | |

FOREIGN PATENT DOCUMENTS

| | | | |
|---|---|---|---|
| 968701 | 7/1950 | France | 415/72 |
| 681220 | 8/1979 | U.S.S.R. | 415/72 |

*Primary Examiner*—John T. Kwon
*Attorney, Agent, or Firm*—Christopher H. Hunter

[57] ABSTRACT

A centrifugal pump for a fluid tank includes a pump housing enclosing an electric motor, a primary impeller coupled to the drive shaft of the motor, and a secondary impeller extending axially downward from the primary impeller proximate to the floor of the tank. The secondary impeller has a central stem and helical blades formed integrally with the stem and extending radially outward therefrom. An outer shroud encloses the central stem and helical blades of the secondary impeller. The outer shroud is fixedly secured to the helical blades and rotates in conjunction with the secondary impeller. The secondary impeller is either formed in one piece with the primary impeller or is removably attached by, e.g., screwing a threaded shaft on the secondary impeller into a corresponding through-bore in the primary impeller and the motor drive shaft. The secondary impeller has a smaller diameter than the primary impeller such that the primary impeller has a first fluid flow path directly from the fuel tank and a second fluid flow path through the secondary impeller. When the level of fluid in the tank is above the level of the primary impeller, the primary impeller draws fluid directly from the tank into the pump. The secondary impeller also provides a small amount of fluid to the primary impeller, and the primary impeller operates at or near its maximum possible capacity. When the level of fluid falls below the working level of the primary impeller, the primary impeller ceases to draw fluid directly from the tank, however, the secondary impeller continues to draw fluid up to the primary impeller to maintain operation of the pump. The secondary impeller thereby draws fluid down to a lower level in the tank to maximize the amount of usable fuel in the tank.

20 Claims, 3 Drawing Sheets

FUEL PUMP IMPELLER WITH PUMP DOWN EXTENSION

FIELD OF THE INVENTION

The present invention relates generally to pump construction, and in particular, to a design for a centrifugal fuel pump.

BACKGROUND OF THE INVENTION

Centrifugal pumps are commonly used to move fluid from one location to another, for example to remove fuel from an aircraft fuel tank and provide the fuel to remote equipment, e.g., to a turbine engine, or to move the fuel from tank to tank. Centrifugal pumps typically have a motor and an impeller enclosed within a housing. The motor rotates the impeller, which in turn draws fluid through an inlet opening in the housing and discharges the fluid (typically under pressure) through an outlet opening. The impeller has an axially-extending stem coupled to the drive shaft of the motor. Radially extending helical blades are formed integrally with the stem of the impeller and are enclosed by an axially-extending cylindrical shroud or sleeve. The stem and helical blades rotate within the shroud to draw the fluid into a volute chamber in the housing. The volute chamber converts the kinetic energy imparted to the fuel by the impeller into pressure and discharges the fluid through the outlet in the housing. Centrifugal pumps are available from a wide variety of manufacturers, including the assignee of the present invention. Exemplary centrifugal pumps are also shown in Carter, U.S. Pat. Nos. 3,652,186; Ridland, 2,846,952; Kalashnikov, 4,275,988; Davis et al, 4,142,839; and Bell, 3,038,410.

Certain centrifugal pumps mounted within fuel tanks are known as "wet pumps." These explosion-proof pumps are typically orientated vertically within the tank—with the motor being located above the impeller in the direction of fuel flow. A certain minimum floor clearance must be maintained between the blades of the impeller and the bottom wall or floor of the tank to provide efficient pumping of fluid. If the impeller is too close to the bottom wall of the tank, "inlet choking" of the impeller can occur and the impeller will not draw fuel efficiently. This floor clearance is evident in the impellers illustrated in the patent references cited above. The preferred floor clearance for a centrifugal pump is easily determined by those of ordinary skill in the art knowing the structural characteristics of the centrifugal pump, and as a rule of thumb, is about 50% of the outer diameter of the impeller.

However, any set-off between the impeller and the floor of the tank necessarily results in unusable fuel. That is, the impeller can only pump fuel down to the bottom of the impeller blades. Any fuel below this level cannot be reached by the impeller. If the fuel tank is mounted within an aircraft, the unusable fuel adds to the total weight of the aircraft. This additional weight can be substantial. For example, in a typical airplane fuel tank of 30 square feet in width, every unusable inch of fuel increases the weight of the airplane by approximately 120 pounds. When this amount is multiplied by two or more fuel tanks in an airplane, the weight factor of this unusable fuel becomes an important consideration in airplane design, particularly when fuel economy and flight range are important factors.

One known method for addressing this problem has been to mount the pump in a recess in the fuel tank. The fuel flows into the recess as the pump is drawing the fuel out of the tank, thereby resulting in removing fuel to a lower level. Ridland, U.S. Pat. No. 2,846,952, shows such a configuration. However, this method is not without drawbacks. For example, if the fuel tanks are already installed in an aircraft, the tanks must be removed and modified or replaced with tanks having a recess, which increases the cost of the aircraft as well as removes the aircraft from service for an extended time. Further, some fuel tanks are formed from flexible bladders enclosed by a rigid frame or shell. The bladders do not lend themselves to any particular configuration and hence make it difficult to form a useable recess.

In any case, it is believed that there is a demand in the industry for a centrifugal pump which can operate with existing tank configurations, does not require costly modification or downtime of the aircraft, and maximizes the amount of usable fuel in a fuel tank.

SUMMARY OF THE INVENTION

The present invention provides a centrifugal pump which can be used with existing tank configurations in an aircraft, does not require the fuel tank to be modified or replaced, and maximizes the amount of fuel which can be drawn from the fuel tank. The centrifugal pump includes a pump housing enclosing an electric motor, a primary impeller coupled to the drive shaft of the motor, and a secondary impeller extending axially downward from the primary impeller in the direction of fluid flow. The secondary impeller draws fuel up to the primary impeller when the level of fuel is below the working level of the primary impeller. The secondary impeller maximizes the amount of usable fuel in a fuel tank but has a negligible effect on the operation of the primary impeller when the level of fuel is above the working level of the primary impeller.

The secondary impeller of the present invention includes a central stem and helical blades formed integrally with the stem and extending radially outward therefrom. An annular outer shroud encloses the central stem and helical blades. Preferably, the outer shroud is fixedly secured to the helical blades of the secondary impeller and rotates in conjunction therewith. The helical blades define fluid flow channels to draw fluid axially up the secondary impeller to the primary impeller.

The secondary impeller is either formed in one piece with the primary impeller or is attached by, e.g., screwing a threaded shaft on the secondary impeller into a corresponding through-bore formed in the primary impeller and the drive shaft. The secondary impeller has a smaller radial diameter than the primary impeller such that a first fluid flow path is defined around the outside periphery of the secondary impeller directly to the primary impeller, and a second fluid flow path is defined through the secondary impeller and then up to the primary impeller. The secondary impeller preferably extends down as close as possible to the floor of the tank to maximize the amount of usable fuel in the tank.

When the centrifugal pump is mounted vertically within a fuel tank, the primary impeller draws fuel directly from the tank when the level of fuel is above the working level of the primary impeller. The primary impeller draws the fuel around the outside diameter of the secondary impeller up to the volute chamber in the pump. A certain amount of fuel is also drawn up by the secondary impeller to the primary impeller. The primary impeller is provided with at least a minimum floor clearance and operates at or near its maximum possible capacity.

When the level of fuel in the tank falls below the working level of the primary impeller, the primary impeller ceases to draw fuel directly from the fuel tank. However, the secondary impeller continues to draw fuel up to the primary impeller because of its closer proximity to the tank floor. In this way, the secondary impeller can draw fuel down to a lower level in the tank. The secondary impeller thereby provides more usable fuel in the tank, which decreases the amount of fuel which must be carried in the tank and decreases the over-all weight of the aircraft.

Thus, as described above, the present invention provide a unique centrifugal pump having a secondary impeller which is formed from relatively few parts, is easy to manufacture and install, and can even be easily fitted onto existing centrifugal pumps or installed as original equipment to maximize the amount of fuel which can be used in a fuel tank.

While the present invention has been described above with respect to fuel pumps for aircraft, it should also be understood that the present invention has a wide variety of other uses where it is important to remove as much fluid in a tank as possible. These other uses should be readily apparent to those of ordinary skill in the art. Still other features and advantages of the present invention will become more apparent from the following detailed description and accompanying drawings.

DETAILED DESCRIPTION OF THE PREFERRED EMBODIMENT

Figure 1:
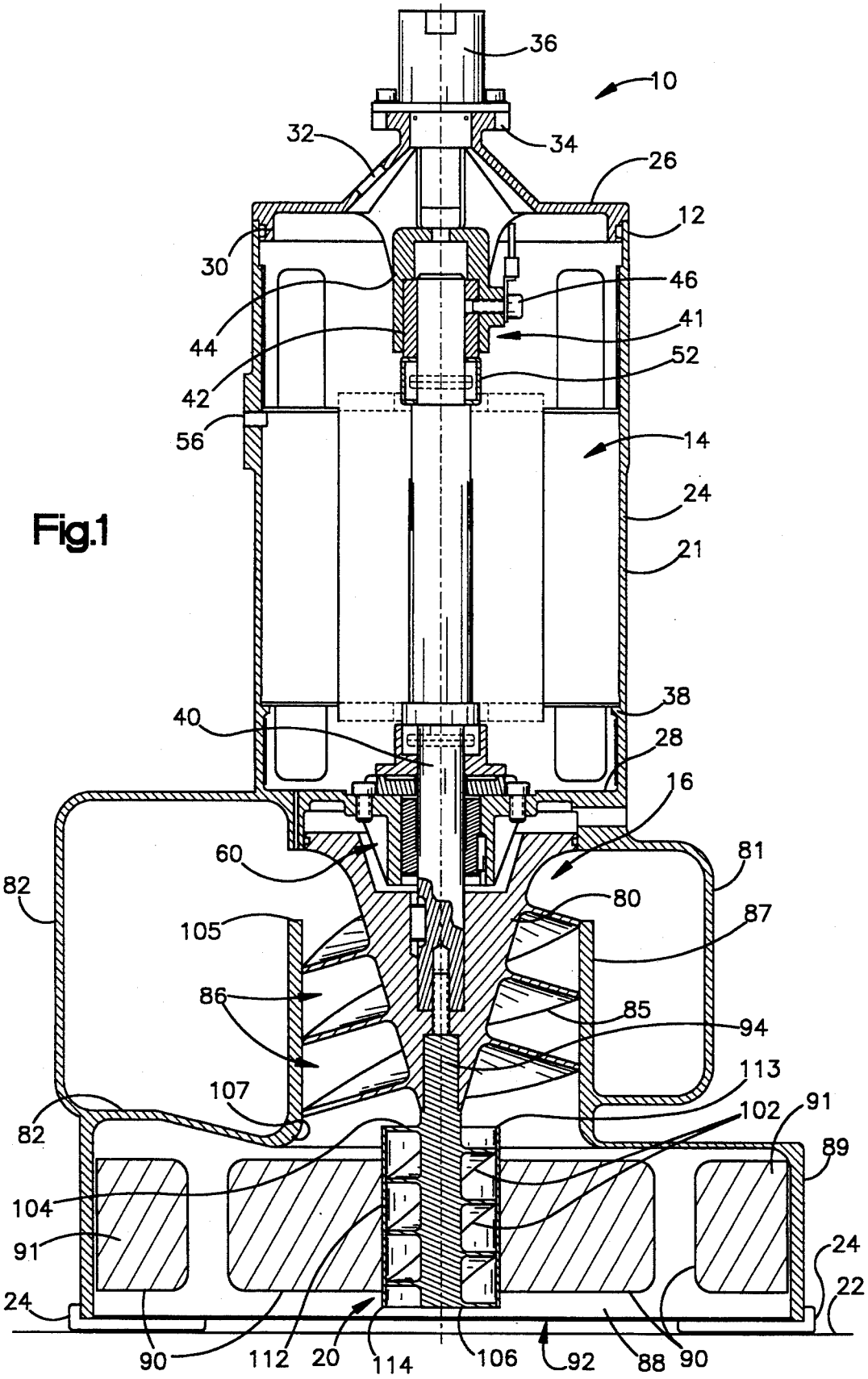
FIG. 1 is a cross-sectional side view of a centrifugal pump constructed according to the principles of the present invention.
Figure 2:
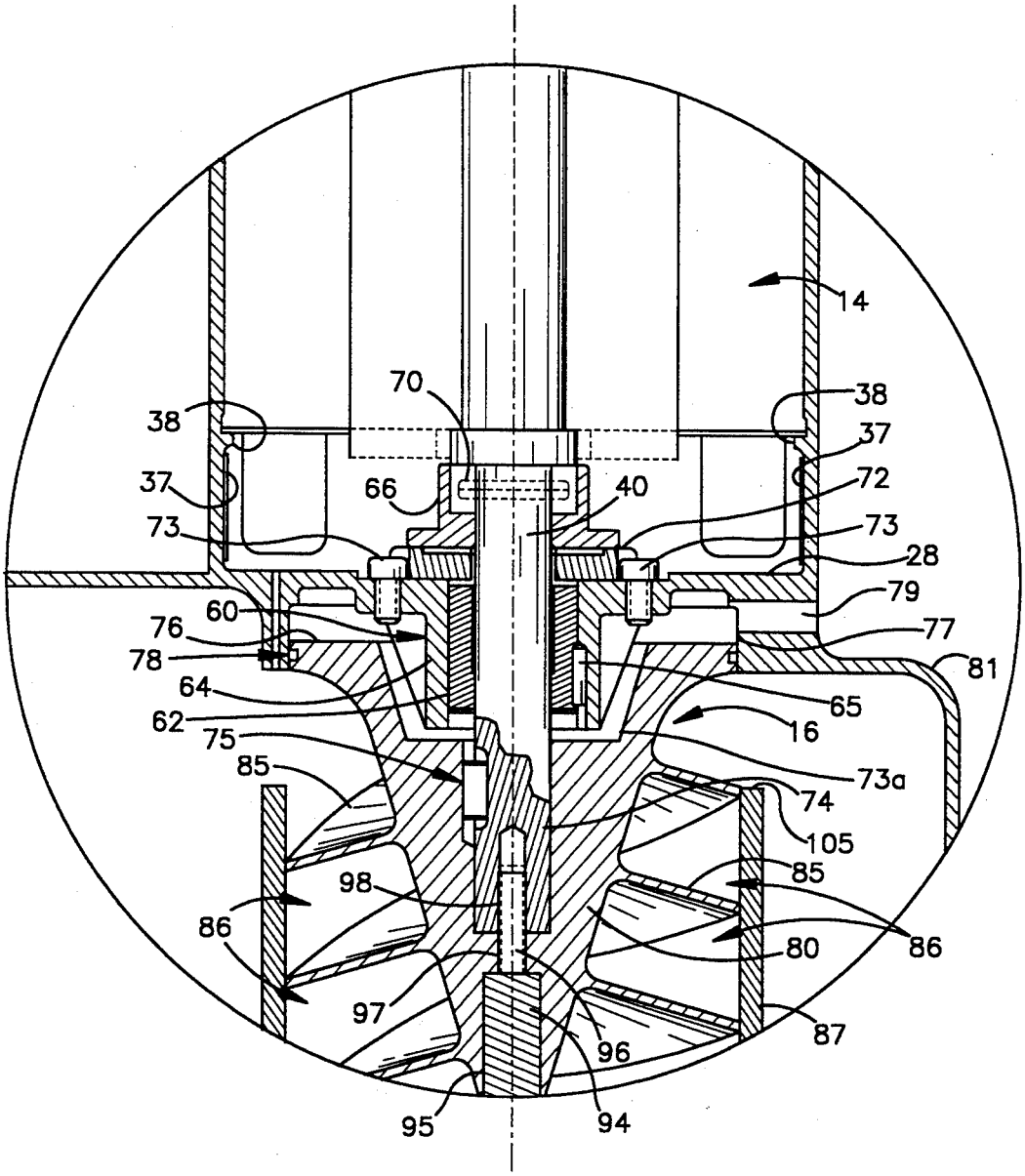
FIG. 2 is an enlarged cross-sectional side view of the lower bearing assembly for the centrifugal pump of FIG. 1.

Referring now to the drawings, and initially to FIGS. 1 and 2, a centrifugal pump assembly is indicated generally at 10 which is constructed according to the principles of the present invention. The centrifugal pump assembly includes an outer pump housing or casing 12 which encloses a motor, indicated generally at 14, a primary impeller, indicate generally at 16, and a secondary impeller, indicated generally at 20. The centrifugal pump assembly is preferably mounted in a conventional manner to a tank floor or end wall, indicated schematically at 22. Mounting pads or feet 24 extend radially outward from the bottom of housing 12 (see, e.g., FIG. 3) and can be attached to the tank floor in a conventional manner.

As will be described herein in more detail, the pump housing 12, motor 14 and primary impeller 16 are preferably constructed according to conventional designs and are available from a wide variety of manufacturers. The principles of the present invention are intended to be applicable to the original manufacturing of centrifugal pumps as well as to centrifugal pumps which have previously been installed in a tank. In other words, the principles of the present invention are intended to be applicable to a wide variety of commercially-available centrifugal pumps. Thus, the following description of the pump housing, motor, and primary impeller are intended to be illustrative only and not in limiting the principles of the present invention.

With the above in mind, the motor 14 of the centrifugal pump is preferably enclosed within a motor chamber 21 of the pump housing. The motor chamber includes cylindrical sidewalls 24 enclosed at one end by endcap 26 and at the other end by endwall 28. An appropriate sealing element 30, e.g., an O-ring-type seal, is located between endcap 26 and sidewall 24 to fluidly seal the end of the housing. Endcap 26 includes an outwardly-tapered neck portion 32 which terminates in a radially-extending flange 34 to form an opening for the housing. A cable fitting 36 is attached to the periphery of flange 34 such as by e.g., screws or nuts, to provide an exterior electrical interface for motor 14. Appropriate insulation, e.g., insulating layer 37, can be applied to the inside surface of the housing as a spark arrester.

The motor 14 is preferably an electric driving motor of any suitable explosion-proof sealed type for submerged operation. The motor includes a sealed annular stator (not numbered) with an outer cylindrical wall which fits within the sidewall of the motor chamber, and an inner cylindrical wall which surrounds an annular rotor (also not numbered). The stator of the motor is located and retained between endcap 26 on one end, and shoulder 38 of sidewall 24 at the other end. The motor also preferably has a thermal fuse assembly (not shown), as is known to those in the art. Although a specific type of motor has been described above, it should be apparent to those skilled in the art that the motor could also comprise other drive means such as an air turbine, a hydraulic motor, or any other type of means for transferring energy to mechanical motion. In any case, the dynamic requirements of the motor can be easily determined knowing the requirements of the pump, e.g., the differential head necessary, the running speed, the liquid characteristics, and the available power supply.

A rotatable drive shaft 40 extends centrally through the motor and is integrally connected to the rotor in a conventional manner. The drive shaft 40 defines the central axis of the pump. The upper end of the drive shaft is supported for rotational movement on an upper bearing assembly, indicated generally at 41. The upper bearing assembly 41 includes a radial bearing sleeve assembly 42 which is located within a cup-shaped bearing housing 44. The bearing housing 44 is integrally attached to the pump housing in a conventional manner. A radially-extending pin or screw 46 extends through bearing housing 44 to secure bearing 42 to the pump housing. A thrust washer 52 is located around drive shaft 40 between bearing 42 and motor 14. The thrust washer 52 is rotatably held on the drive shaft by a spring-biased pin 54. Finally, a set screw 56 extends radially inward through the sidewall 24 of the housing to anchor the stator of the motor to the housing and prevent relative axial and rotational movement of the stator.

The drive shaft 40 of the motor is also rotatably supported at its lower end on a lower bearing assembly, indicated generally at 60. The lower bearing assembly includes a radial bearing sleeve assembly 62 which is received within a cup-shaped bearing housing 64, formed in part by the endwall 28. Bearing 62 is rotationally and axially fixed to bearing housing 64 by an elongated locking key or pin 65 which is received within corresponding slots formed in bearing 62 and bearing housing 64. A lower thrust washer 66 is rotatably held on drive shaft 40 between the lower bearing 62 and the motor 14. A spring-biased pin 70 retains the lower thrust washer 66 on the drive shaft 40. A thrust bearing 72 is located around the drive shaft 40 between the thrust washer 66 and housing endwall 28. Set screws 73 extend axially through endwall 28 and thrust bearing 72 to locate and retain the thrust bearing within the housing. The drive shaft 40 of the motor is supported between and freely rotates on upper bearing assembly 41 and lower bearing assembly 60. Again, the motor and the means for supporting the motor are conventional in nature and can vary depending upon the particular application.

The primary impeller 16 is preferably an inducer-type impeller which is coupled to the lower end of the motor drive shaft 40 and extends axially downward therefrom. The primary impeller includes a counter-bore 73*a* at its upper end which receives the lower bearing assembly 60, and a central bore 74 which extends downward from the counter bore 73 and receives motor drive shaft 40. A key-in-slot connection, indicated generally at 75, retains the primary impeller 16 on the drive shaft 40 and prevents relative axial and rotational movement thereof.

The primary impeller 16 has an upper annular flange 76 which fits within an annular sleeve 77 extending downwardly from motor chamber endwall 28. The peripheral edge of impeller flange 76 includes a dynamic fluid seal, indicated generally at 78, between the flange and the housing. This dynamic seal 78 enables the impeller to rotate freely within sleeve 77. Seal 78 also allows a certain amount of fluid leakage into the motor chamber to lubricate the bearings and cool the motor. A radial drain hole 79 is provided in sleeve 77 to equalize fluid pressure within the housing. A corresponding drain hole (not shown) can also be formed in the upper portion of the housing, for example in the upper flange 34.

Figure 3:
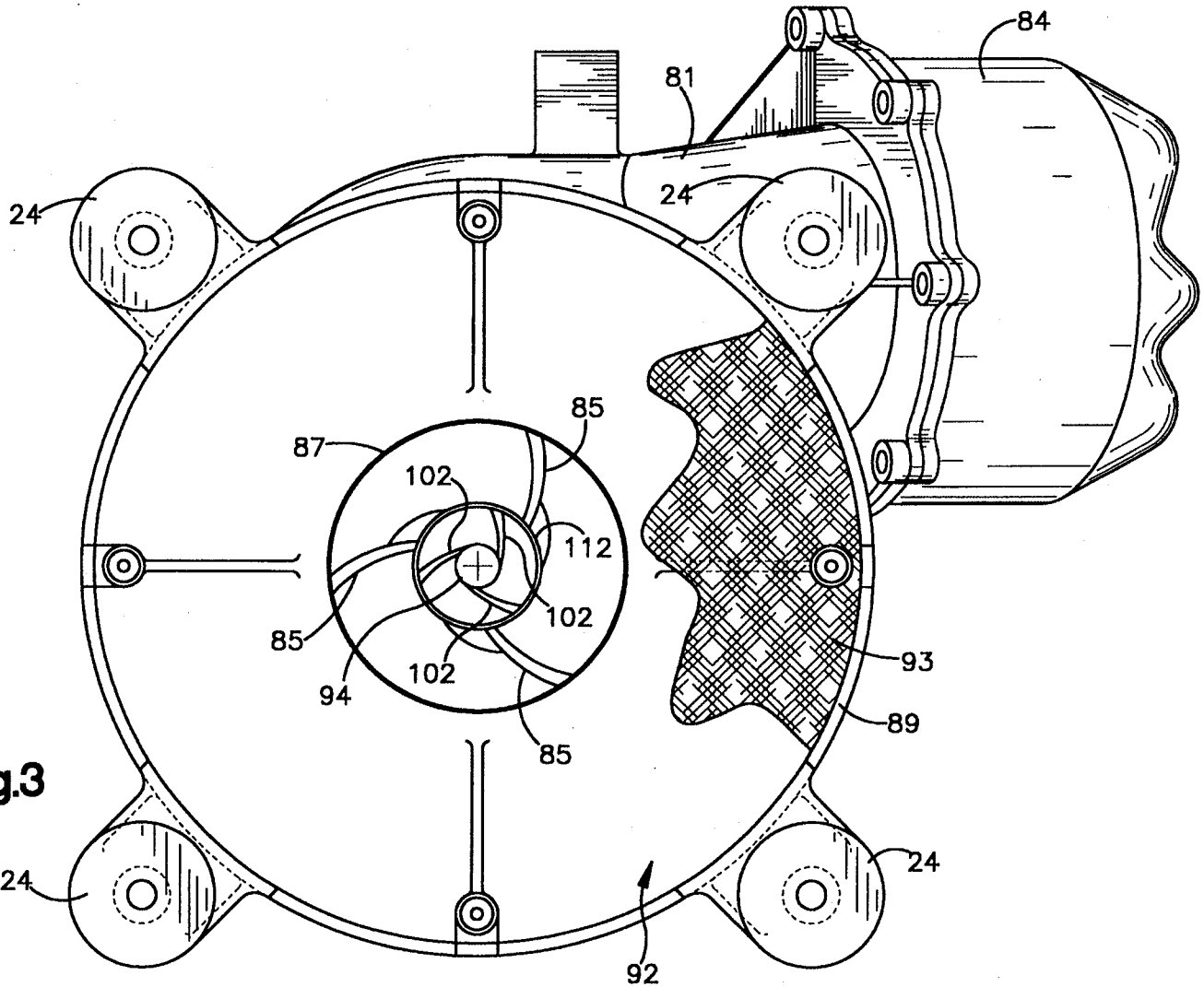
FIG. 3 is a bottom view of the centrifugal pump of FIG. 1 with certain components removed to show the primary impeller and the secondary impeller design.

The primary impeller 16 includes a central, cone-shaped stem or hub 80 which extends downwardly from the drive shaft along the axis of the pump. The central stem extends into a volute chamber 81, which is formed by motor chamber endwall 28, cylindrical sidewall 82 extending downwardly from endwall 28, and opposite endwall 83. The volute chamber is designed to discharge fluid (typically under pressure) to a discharge housing 84 (FIG. 3). A plurality of helical or auger-shaped blades 85 are preferably formed in one piece with and extend substantially radially outward from the central stem 80. The helical blades form channels, indicated generally at 86, to draw fluid up the impeller when the central stem is rotated. The helical blades 85 on the primary impeller preferably comprise two or more set of blades extending fully or partially (e.g., in segments) along the side of the primary impeller.

The central stem 80 and helical blades 85 of the primary impeller are surrounded by an axially-extending annular sleeve or shroud 87 which is formed in one piece with and extends upwardly from endwall 83 into the volute chamber 81. The upper edges of the impeller blades terminate at a common radial plane and are preferably flush with the upper end 105 (i.e., the outlet opening) of the impeller shroud. Similarly, the lower end of the impeller blades terminate along a common radial plane proximate the lower end 107 (i.e., the inlet opening) to the impeller shroud 87. The blades of the primary impeller preferably extend radially outward in close proximity to the inside surface of the shroud 87 as is well known in the art. The dimensions of the stem 80, blades 85, and shroud 87 are preferably chosen so as to maximize the capacity of the primary impeller for a particular application. As indicated previously, these characteristics, as well as the dimensions of the volute chamber 81, can be easily determined by those of ordinary skill in the art based on such factors as the dimensions and volumetric capacity of the pump and the intended rotational speed of the impeller.

The secondary impeller 20 is co-axial with and extends downwardly from the primary impeller 16 into housing inlet chamber 88. Inlet chamber 88 has a cup or bell-shaped configuration formed by volute chamber endwall 83 and cylindrical sidewalls 89, which extend downwardly from the end wall. The inlet chamber preferably has a plurality of fuel inlet openings 90 formed in the sidewall 89 circumferentially around the chamber. Each of the openings 90 is covered by a grille or screen 91 to filter out unwanted particles. Additionally, the inlet chamber 88 also preferably forms a fuel inlet opening, designated generally at 92, at the lower distal end of sidewall 89. This opening 92 is also covered by a grille or mesh 93 (FIG. 3) to prevent unwanted particles from entering the pump. As should be apparent to those skilled in the art, the above-described fuel inlet openings are only one exemplary type of a fuel inlet opening for a centrifugal pump. The scope of this invention is intended to encompass other types of fuel inlet openings as well.

In any case, the secondary impeller 20 can be formed in one piece with the primary impeller 16 as a common hub, or, as illustrated, can be integrally attached as a separate piece. In the latter instance, the secondary impeller can include an upwardly-extending central stem or shaft 94 (FIG. 2) which is received within a bore 95 formed axially within the primary impeller 16. A second, threaded shaft 96 extends upwardly from the first shaft 94 and is received within a smaller, through-bore 97 formed in the primary impeller, and in a corresponding threaded bore 98 formed axially in the lower end of the drive shaft 40. This aspect of the present invention enables the secondary impeller to be easily attached to previously-manufactured centrifugal pumps by merely forming the above-mentioned bores within the primary impeller and/or drive shaft and attaching the secondary impeller. In any case, the secondary impeller is fixedly attached to and rotates in conjunction with the primary impeller (and hence the drive shaft) along the axis of the pump.

As with the primary impeller, a series of helical or auger-shaped blades 102 are formed integrally with and extend radially outward from the central stem 94 of the secondary impeller. Again, the number of blades is chosen depending upon the particular requirements of the pump. The helical blades 102 preferably terminate in a common radial plane at the upper edges 104 of the secondary impeller. Similarly, the blades also preferably terminate in a common radial plane at the lower edges 106 of the secondary impeller. The upper edges 104 (FIG. 1) of the secondary impeller project slightly upward into the opening 107 to the volute chamber shroud 87. The lower edges 106 of the secondary impeller preferably extend practically to the bottom of the pump housing, and hence closely proximate to the floor 22 of the fuel tank, as will be described herein in more detail.

An outer annular shroud or sleeve 112 encloses the helical blades 102 and central stem 94 of the secondary impeller. The outer shroud 112 is preferably fixedly secured to the helical blades 102, and hence rotates in conjunction with the rotation of the secondary impeller. The outer shroud can be attached to the helical blades such as by forming an interference fit between the shroud and the blades. Other means for attaching the outer shroud to the helical blades, such as by brazing or welding, are also within the scope of the present invention. The upper and lower ends of the outer shroud 112 are preferably flush with the upper and lower ends of the helical blades. That is, the upper end 113 of the outer shroud 112 (i.e., the outlet opening) is preferably flush with the upper edges 104 of the helical blades, while the lower end 114 of the outer shroud (i.e., the inlet opening) is preferably flush with the lower edges 106 of the helical blades. The distal edges of the helical blades at the upper end 104 of the secondary impeller preferably abut and are matched, helically, with the leading edges of the primary impeller blades. That is, the helixes of the primary and secondary impellers are preferably continuous across their interface. This provides for smoothly and efficiently drawing fluid from the secondary impeller up to the primary impeller when the motor drive shaft is rotated.

The outer diameter of the secondary impeller 20 is relatively smaller than the outer diameter of the primary impeller 16. As such, a first, annular fluid flow path is formed between the shroud of the secondary impeller and the shroud of the primary impeller. When the level of fluid is above the level of the primary impeller, the fluid flows through the fluid inlet openings 90, 92 and is drawn through the first fluid flow path around the outside periphery of the secondary impeller 20, that is around the outside of the shroud 112, and into the shroud 87 of the primary impeller. As is known to those skilled in the art, the majority of an impeller's function occurs at the outer diameter of the blades, rather than along its axis. Hence, the axial location of the secondary impeller in the flow path of the primary impeller does not substantially effect the operation of the primary impeller. Moreover, fluid is also drawn through a second fluid flow path through the secondary impeller to the primary impeller. This amount of fluid is less than that which is being drawn up directly by the primary impeller due to the larger diameter of the primary impeller, and, in any case, the primary impeller operates at or near its maximum possible capacity. In sum, the diameter of the secondary impeller is chosen so as to minimize interruption of the primary impeller when the level of fluid is above the working level of the primary impeller. The ratio between the diameter of the primary impeller to that of the secondary impeller can be easily determined by those of ordinary skill in the art. Preferably, the ratio of the diameter of the primary impeller to the secondary impeller is on the order of 2:1, although again, this could vary depending on the particular application for the pump.

The axial length of the secondary impeller also varies depending on the particular application. The primary impeller is mounted at least as far from the tank floor as its preferred floor clearance such that the primary impeller operates at its maximum possible capacity. The length of the secondary impeller is then chosen such that the secondary impeller extends from the primary impeller down to a level just above the floor level. When the level of fluid drops below the working level of the primary impeller, the secondary impeller continues to draw fluid up through the second flow path to the primary impeller. The distance between the floor level and the secondary impeller can also be chosen so as to maximize the efficiency of the secondary impeller. This minimum distance, again, is easily determined by one of ordinary skill in the art knowing the characteristics of the secondary impeller. Since the secondary impeller is relatively smaller in diameter and capacity than the primary impeller, the minimum distance from the tank floor for optimum performance of the secondary impeller will be less than that for the primary impeller, and so fuel will be drawn down to a lower level.

However, this "minimum distance" for the secondary impeller from the tank floor will still leave the unusable fuel below this level, which is some situations might not be acceptable in terms of additional weight. The secondary impeller can therefore be located closer to the floor than the minimum floor clearance for the impeller. While the secondary impeller might not operate at maximum efficiency at this location, the gain in mission range and reduction in aircraft weight might offset this drawback in certain situations. Therefore, in general, it is preferred that the floor clearance for the secondary impeller be chosen so as to maximize the amount of fuel which can be drawn from the tank. In essence, the length of the secondary impeller can vary depending on the particular application and is only loosely defined above in terms of its dimensions.

The operation of the centrifugal pump assembly of the present invention should be apparent from the foregoing description. However, it will nonetheless be briefly described. When fuel is above the working level of the primary impeller, the fuel flows into the inlet chamber(s) and is drawn up by the primary impeller to the volute chamber. Fuel is then discharged out of the volute chamber, to e.g., remote equipment, or to another fuel tank. The majority of the fuel passes around the secondary impeller as described above and is drawn up directly by the primary impeller. A portion of the fluid is also drawn up by the secondary impeller and provided to the primary impeller. In any case, the primary impeller operates at or near its maximum possible capacity as the secondary impeller has a negligible effect on the operation of the primary impeller.

When the level of fuel falls below the working level of the primary impeller, the primary impeller no longer draws fuel directly from the tank to the volute chamber. Rather, only the secondary impeller continues to draw fuel up to the primary impeller. The momentum and velocity of the fuel imparted from the secondary impeller maintains the fuel flowing upward into the blades of the primary impeller. Moreover, since the secondary impeller extends a short distance upward into the shroud of the primary impeller, all the fuel exiting the upper end of the secondary impeller will be captured by the primary impeller, and continue its upward movement rather than draining back into the inlet chamber. If the secondary impeller is sized correctly, the secondary impeller will draw the fuel practically to the bottom of the tank floor. While the amount of fuel drawn up by the secondary impeller may not be as great as the optimum capacity of the primary impeller, the secondary impeller allows the fuel to be drawn down to a lower level in the tank.

Hence, as described above, the present invention provides a novel and unique centrifugal pump which maximizes the amount of fluid which can be drawn from a tank. The centrifugal pump includes a secondary impeller which is formed from relatively few parts, is easy to manufacture and install, and can be attached as a separate piece or formed integrally with the primary impeller of the centrifugal pump. The centrifugal pump operates at or near its maximum possible capacity when fluid is above the working level of the primary impeller, yet continues to draw fluid practically to the bottom of the tank.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A centrifugal pump comprising: a primary impeller, said primary impeller being rotatable and including an axially-extending central stem, helical blades extending radially outward from the central stem, and a shroud enclosing the central stem and helical blades of the primary impeller, and a secondary impeller coupled to and rotatable with said primary impeller, said secondary impeller including an axially-extending central stem, helical blades extending radially outward from the central stem, and a shroud enclosing the central stem and helical blades of the secondary impeller, the outside diameter of the secondary impeller being less than the outside diameter of the primary impeller such that the shroud enclosing the primary impeller and the shroud enclosing the secondary impeller cooperatively define an annular fluid opening to provide a first fluid flow path around the outside of the secondary impeller directly into the primary impeller and a second fluid flow path through the secondary impeller into the first impeller.

2. The centrifugal pump as in claim 1, wherein the shroud of said secondary impeller rotates in conjunction with the rotation of said secondary impeller.

3. The centrifugal pump as in claim 2, wherein the shroud of said secondary impeller is fixedly secured to the helical blades of said secondary impeller.

4. The centrifugal pump as in claim 3, wherein the shroud of said secondary impeller is held by an interference fit to the helical blades of said secondary impeller.

5. The centrifugal pump as in claim 1, wherein the secondary impeller and the primary impeller are formed of two separate pieces which include attachment means for attaching the secondary impeller to the primary impeller.

6. The centrifugal pump as in claim 5, wherein the attachment means comprises a threaded shaft received in an axially-extending bore formed in the central stem of said primary impeller.

7. The centrifugal pump of claim 1, wherein the secondary impeller extends axially inwardly into the area defined by the shroud of said primary impeller.

8. The centrifugal pump as in claim 1, wherein the helix of the blades of the secondary impeller are matched with the helix of the blades of the primary impeller.

9. The centrifugal pump as in claim 1, wherein the secondary impeller extends from an upper end proximate the primary impeller to a lower end spaced away from the primary impeller, said shroud and blades terminating along a common plane normal to the axis of the housing at the upper end of the secondary impeller and at another common plane normal to the axis of the housing at the lower end of the secondary impeller.

10. The centrifugal pump as in claim 1, wherein the ratio of the outside diameter of the primary impeller to the outside diameter of the secondary impeller is about 2:1.

11. An apparatus for pumping fluid, comprising:

a primary impeller and a secondary impeller, said primary impeller and secondary impeller being disposed within a pump housing, said secondary impeller including a central stem, helical blades extending outward from said central stem of said secondary impeller and defining a plurality of fluid channels to draw fluid through said secondary impeller, and a shroud enclosing said central stem and helical blades of said secondary impeller, said primary impeller and said secondary impeller rotating within said housing, an annular first fluid flow passage defined around the exterior of said secondary impeller shroud directly into the primary impeller, and a second fluid flow passage defined through the secondary impeller into said primary impeller.

12. The apparatus as in claim 11, wherein said primary impeller includes a central stem, blades extending outward from the central stem defining a plurality of blade channels to draw fluid through the primary impeller, and a shroud enclosing said central stem and blades of said primary impeller, said shroud of said primary impeller defining a fluid opening which is of greater diameter than a fluid opening defined by the shroud enclosing the secondary impeller.

13. The apparatus as in claim 11, wherein said shroud of said secondary impeller is fixedly secured to and rotates in conjunction with the rotation of said secondary impeller.

14. The centrifugal pump as in claim 13, wherein said secondary impeller includes an attachment device for attaching the secondary impeller to said primary impeller.

15. A pump for a fuel tank, comprising:

a pump housing, a motor disposed within said pump housing, said motor including a rotatable drive shaft defining a central axis of said pump housing, a primary impeller coupled to said motor drive shaft and extending downward from the drive shaft as viewed along the direction of fluid flow, said primary impeller including an axially-extending central stem, helical blades extending radially outward from the central stem defining a plurality of blade channels to draw fluid through the primary impeller, and a shroud enclosing the central stem and helical blades of the primary impeller, and a secondary impeller rotatable with said primary impeller and extending downwardly from said primary impeller as viewed along the direction of fluid flow, said secondary impeller including an axially-extending central stem, helical blades extending radially outward from said central stem of said secondary impeller defining a plurality of fluid channels to draw fluid through said secondary impeller, and a shroud enclosing the central stem and helical blades of the secondary impeller, said primary impeller being in direct open fluid communication to the fuel tank to define a first flow path axially along the outside of the shroud of said secondary impeller to the primary impeller, and a second fluid flow path through said secondary impeller into said primary impeller.

16. The pump as in claim 15, wherein said housing is mounted to a floor of the fuel tank, and the secondary impeller extends down to a location closer to the floor than the primary impeller.

17. The pump as in claim 16, wherein the primary impeller and said secondary impeller have configurations which define a first fluid path directly into the primary impeller which bypasses the secondary impeller, and a second fluid path initially through the secondary impeller and then into the primary impeller.

18. A pump comprising:

a primary impeller and a secondary impeller, said secondary impeller being coaxial with and adjacent said primary impeller, said impellers each having a central stem and helical auger-shaped blades extending radially outward from said central stem and terminating at a radially outward helical end surface, said blades of said primary impeller and said blades of said secondary impeller having a blade direction which draws fluid from the secondary impeller to the primary impeller, a primary shroud closely adjacent and enclosing said blades of said primary impeller and a secondary shroud closely adjacent and enclosing said blades of said secondary impeller, said primary shroud being stationary, and said primary impeller and said secondary impeller and said secondary shroud being rotatably disposed relative to said primary shroud.

19. A pump comprising:

a primary impeller and a secondary impeller, said secondary impeller being coaxial with and adjacent said primary impeller, said impellers each having a central stem and helical auger-shaped blades extending radially outward from said central stem and terminating at a radially outward helical end surface, a primary shroud enclosing said primary impeller and a secondary shroud enclosing said secondary impeller, said primary shroud being stationary, and said primary impeller and said secondary impeller and said secondary shroud being rotatably disposed relative to said primary shroud, said shroud of said primary impeller has an end adjacent an end of said shroud of said secondary impeller, said end of said shroud of said primary impeller has a diameter substantially greater than the diameter of said end of said shroud of said secondary impeller, said end of said shroud of said primary impeller and said end of said shroud of said secondary impeller defining an annular fluid flow path into said primary impeller, and said end of said shroud of said secondary impeller defining another fluid flow path concentric with said annular fluid flow path into said primary impeller.

20. A pump as in claim 19, wherein said end of said shroud of said secondary impeller extends axially into said end of said shroud of said primary impeller.

* * * * *